US008882467B2

(12) United States Patent
Kwok et al.

(10) Patent No.: US 8,882,467 B2
(45) Date of Patent: Nov. 11, 2014

(54) CENTRIFUGAL IMPELLER

(75) Inventors: Lo Ching Kwok, Hong Kong (CN); Dong Xia Liu, Shenzhen (CN); Wei Yu, Shenzhen (CN)

(73) Assignee: Johnson Electric S.A., Murten (CH)

( * ) Notice: Subject to any disclaimer, the term of this patent is extended or adjusted under 35 U.S.C. 154(b) by 476 days.

(21) Appl. No.: 13/014,046

(22) Filed: Jan. 26, 2011

(65) Prior Publication Data

US 2011/0182748 A1 Jul. 28, 2011

(30) Foreign Application Priority Data

Jan. 27, 2010 (CN) ..... 2010 1 0103259

(51) Int. Cl.

| | |
|---|---|
| ***F01D 5/22*** | (2006.01) |
| ***F04D 29/34*** | (2006.01) |
| ***F04D 29/02*** | (2006.01) |
| ***F04D 29/28*** | (2006.01) |

(52) U.S. Cl.

CPC ..... *F04D 29/281* (2013.01); *F04D 29/023* (2013.01)

USPC ..... 416/186 R; 416/214 R

(58) Field of Classification Search

CPC ..... F04D 29/281; F04D 29/282; F04D 29/28; F04D 29/30

USPC ..... 416/181, 182, 186 R, 214 R, 223 R, 416/223 B, 183; 29/889, 889.4

See application file for complete search history.

(56) References Cited

U.S. PATENT DOCUMENTS

| | | | | |
|---|---|---|---|---|
| 3,225,422 | A * | 12/1965 | Sebok | 29/889.4 |
| 3,713,280 | A * | 1/1973 | Keller et al. | 55/360 |
| 4,900,228 | A * | 2/1990 | Yapp | 416/183 |
| 5,328,332 | A * | 7/1994 | Chiang | 416/186 R |
| 5,558,499 | A * | 9/1996 | Kobayashi | 416/186 R |
| 5,573,374 | A * | 11/1996 | Giberson | 416/186 R |
| 6,224,335 | B1 * | 5/2001 | Parisi et al. | 415/206 |
| 2005/0071998 | A1 * | 4/2005 | Rocky et al. | 29/889 |
| 2005/0163614 | A1 * | 7/2005 | Chapman | 415/206 |
| 2006/0280609 | A1 * | 12/2006 | Ranz et al. | 416/182 |
| 2010/0232967 | A1 * | 9/2010 | Oguma et al. | 416/182 |

FOREIGN PATENT DOCUMENTS

| | | |
|---|---|---|
| JP | H 08247094 | 9/1996 |
| JP | 9126185 A | 5/1997 |

* cited by examiner

*Primary Examiner* — Edward Look

*Assistant Examiner* — Michael Sehn

(74) *Attorney, Agent, or Firm* — Muncy, Geissler, Olds & Lowe, P.C.

(57) ABSTRACT

A centrifugal impeller includes a body of antistatic plastic and a back plate made of metal, preferably aluminum. The back plate is fixed to the body is such a way that the back plate can not make accidental contact with a volute of a blower in which the impeller is deployed.

18 Claims, 2 Drawing Sheets

CENTRIFUGAL IMPELLER

CROSS REFERENCE TO RELATED APPLICATIONS

This non-provisional patent application claims priority under 35 U.S.C. §119(a) from Patent Application No. 201010103259.0 filed in The People's Republic of China on Jan. 27, 2010.

FIELD OF THE INVENTION

This invention relates to a centrifugal impeller and in particular, to a centrifugal impeller having antistatic properties for use in a premix blower for a gas fired water heater.

BACKGROUND OF THE INVENTION

A prior art centrifugal impeller for a premix blower for a gas fired water heater is made from metal and includes a back plate, a cover plate with an inlet opening and vanes connected to the back plate and the cover plate. The impeller is arranged inside a volute of the blower and is fixed to a shaft of a motor by way of the back plate. The inlet of the cover plate is located adjacent an inlet of the volute. In operation, a mixture of gas and air flows into the volute through the inlet, passes through the passages formed between the vanes, and flows out from an outlet of the volute. As the impeller is exposed to the mixture of gas and air, the impeller and the volute have antistatic properties to avoid a build up of static on the impeller, which otherwise may result in a static discharge igniting the gas and air mixture. The back plate, vanes and cover plate are made of the same material.

Japanese published Patent Application No. JP9-126185 discloses an impeller whose back plate, cover plate and vanes are all made of aluminum wherein two side edges of the vanes are respectively fixed to the cover plate and back plate. The weight of the impeller is high and its assembly process is complex. Also, accidental contact between the impeller and the volute may produce sparks with the potential to ignite the gas/air mixture. To solve these problems, an impeller with a back plate, cover plate and vanes all made of antistatic plastic was developed. However, its cost is many times the cost of the aluminum impeller.

SUMMARY OF THE INVENTION

Hence there is a desire for an antistatic impeller which is light, will not generate sparks if it makes contact with the volute when in use and is cost effective.

Accordingly, in one aspect thereof, the present invention provides a centrifugal impeller comprising a body and a back plate mounted to the body, wherein the body is made of antistatic plastic and the back plate is made of metal.

Preferably, the body is a monolithic construction of antistatic plastic.

Preferably, the back plate is made of aluminium.

Preferably, the body comprises a cover plate and a plurality of vanes which extend between the cover plate and the back plate.

Preferably, the body further comprises an outer ring which is connected to radially outer ends of the vanes; and the back plate is arranged inside the outer ring.

Preferably, the outer ring extends axially beyond the back plate.

Preferably, the back plate is fixedly connected with a radially inner surface of the outer ring by plastic deformation of the outer ring.

Preferably, the back plate has a plurality of through holes and the vanes have protrusions which extend through the through holes.

Preferably, the protrusions fixedly connect the back plate to the vanes.

Preferably, the body further comprises an inner ring which is connected to radially inner ends of the vanes; and the back plate has a central hole having a periphery fixedly connected with the inner ring.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labelled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
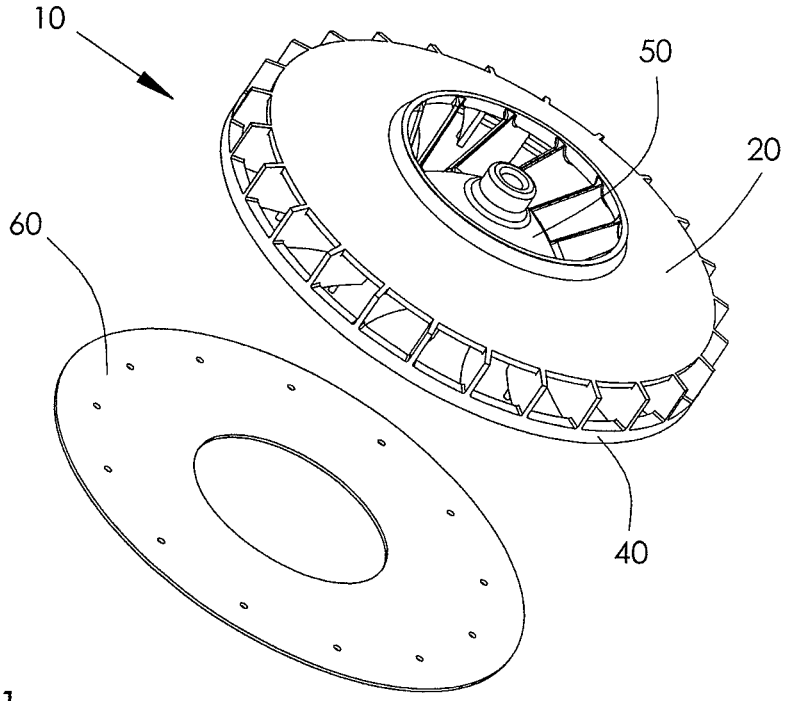
FIG. 1 is an exploded view from above of a centrifugal impeller according to the preferred embodiment of the present invention.
Figure 2:
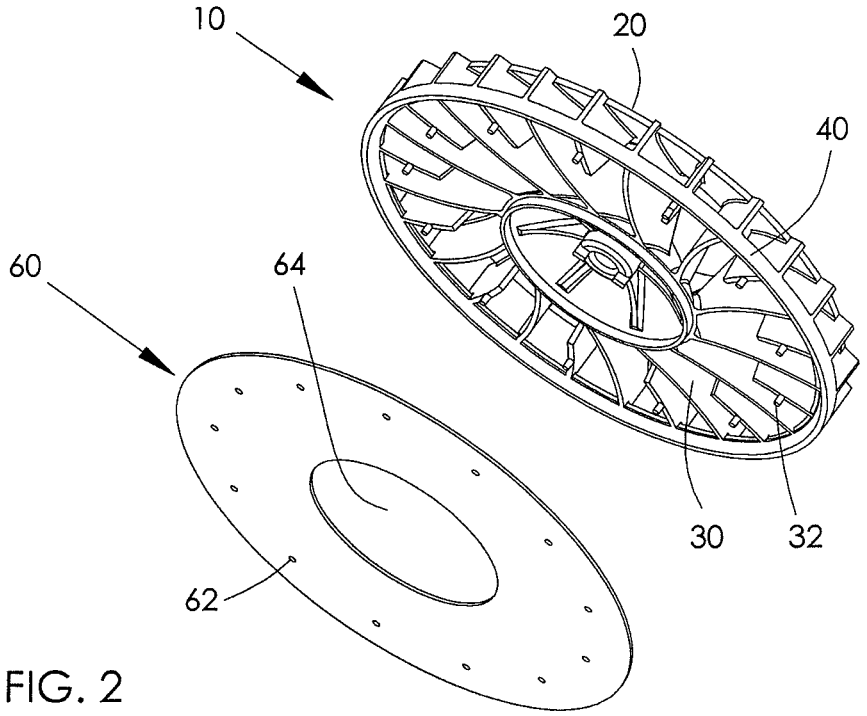
FIG. 2 is an exploded view from below of the impeller of FIG. 1.
Figure 3:
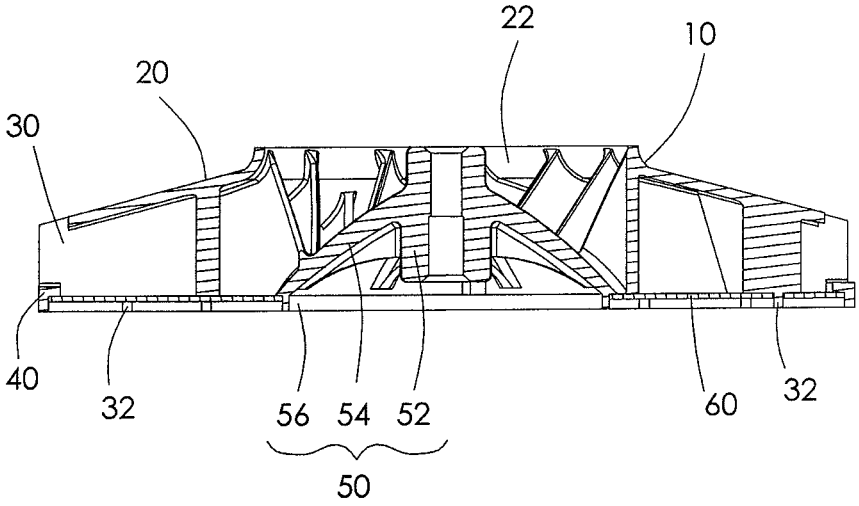
FIG. 3 is a sectional view of the assembled impeller.

The preferred centrifugal impeller comprises a body 10 and a back plate 60 mounted to the body 10. One of the body 10 and the back plate 60 is made of plastic and the other is made of metal.

Preferably, it is the body 10 that is made of antistatic plastic and the back plate 60 is made of metal. The body 10 comprises a cover plate 20 opposite to the back plate 60 and a plurality of vanes 30 which are connected to the cover plate 20 on one side. An air inlet 22 is formed at the center of the cover plate 20. The outer radial ends of the vanes 30 extend beyond the outer periphery of the cover plate 20. Preferably, the body is formed as a single piece item or monolithic construction by injection molding.

The body 10 further comprises an outer ring 40 which is connected to the outer radial ends of the vanes 30. The outer ring 40 is in an axial extended structure. The back plate 60 is disposed inside the outer ring 40 and may be fixedly connected with the inner surface of the outer ring 40 by bonding, welding or preferably by plastic deformation of the outer ring. Preferably, the outer ring 40 is provided with an axial end (the end remote from the cover plate 20) which extends beyond the back plate 60 in the axial direction. This arrangement prevents the outer edge of the back plate from accidentally making contact with the volute. The inner radius of the outer ring 40 is larger than the outer radius of the cover plate 20 to facilitate removing the body 10 from the molding die.

The vanes 30 are provided with protrusions 32 on the side remote from the cover plate 20. The back plate 60 is provided with through holes 62 corresponding to the protrusions 32 for passage of the protrusions 32. Preferably, the protrusions 32 extend through the holes 62, beyond the back plate 60 and are fixedly connected with the back plate 60. Preferably, the protrusions 32 are hot staked or otherwise plastically deformed to fix the back plate to the body.

The body 10 further comprises a hub 50 which comprises a mounting post 52 with a mounting hole and a cone 54 extending from the mounting post 52. An inner ring 56 is formed at the end of the cone 54. The impeller is connected to the motor by fitting and fixing the mounting post 52 to the motor shaft, thus the impeller rotates with the shaft, in a manner generally known. The inner radial ends of the vanes 30 are connected to the outer surface of the cone 54. The back plate 60 is provided with a central hole 64 whose periphery is fixedly connected with the inner ring 50, preferably by plastic deformation of the inner ring. Thus the inner edge of the back plate is prevented from making accidental contact with the volute.

Preferably, the back plate 60 is made of aluminum, ideally by stamping a sheet of aluminum.

In the preferred embodiment of the present invention, the body 10 and the back plate 60 are respectively made of plastic and metal, so the weight of the impeller is lighter and the cost is lower than an impeller made entirely of antistatic plastic. The impeller may be used in a premix blower for a gas fired water heater, because the axial end of the outer ring 40 and/or the protrusions 32 extend beyond the back plate 60, preventing direct contact between the metal back plate 50 and a metal volute of the blower. Such direct contact may generate sparks which would ignite the gas/air mixture with catastrophic results, should the impeller become dislodged during use.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A centrifugal impeller comprising:

a body having:

a cover defining an air inlet at a central portion thereof;

a plurality of vanes integrally formed on a surface of the cover, each vane having a radially inner end; and a hub adjoining the radially inner end of at least one of the plurality of vanes, and having a first axial end facing the air inlet of the cover and a second axial end opposite to the first axial end; and a back plate mounted to the plurality of vanes of the body opposite to the cover, the back plate being a flat sheet and having a radially inner portion attached to the hub, wherein the body is made of a homogenous plastic material by injection molding and formed as a single piece, and the back plate is made of metal;

wherein the body further comprises an outer ring which is connected to radially outer ends of the plurality of vanes, and the back plate is arranged inside the outer ring; and wherein the outer ring has an axial length greater than an axial length of the back plate.

2. The centrifugal impeller of claim 1, wherein the body is a monolithic construction of antistatic plastic.

3. The centrifugal impeller of claim 1, wherein the back plate is made of aluminum by stamping.

4. The centrifugal impeller of claim 1, wherein the back plate is fixedly connected with a radially inner surface of the outer ring by plastic deformation of the outer ring.

5. The centrifugal impeller of claim 1, wherein the back plate has through holes and the vanes have protrusions which extend through the through holes.

6. The centrifugal impeller of claim 5, wherein the number of the plurality of protrusions is less than the number of the plurality of vanes, and the protrusions are evenly spaced along a circumferential direction of the body.

7. The centrifugal impeller of claim 6, wherein the plurality of vanes comprise a plurality of first vanes and a plurality of second vanes, each second vane has a radial length less than a radial length of each first vane, and each protrusion of the body is formed on a respective second vane.

8. The centrifugal impeller of claim 5, wherein the protrusions extend through the holes, beyond the back plate and fixedly connect the back plate to the vanes.

9. The centrifugal impeller of claim 8, wherein the protrusions of the vanes are hot staked onto the back plate.

10. The centrifugal impeller of claim 1, wherein the body further comprises an inner ring formed by the second axial end of the hub which is connected to the radially inner end of the at least one of the plurality of vanes, and the back plate has a central hole whose periphery is fixedly connected with the inner ring of the body.

11. A centrifugal impeller comprising:

a body made of plastic by injection molding, the body having:

a cover plate;

a plurality of vanes disposed on a surface of the cover; and a back plate made of metal and connected to axial ends of the plurality of vanes remote from the cover, the back plate having a first axial end surface facing the plurality of vanes and a second axial end surface opposite to the first axial end surface, wherein the body has a radially outer end defining a receiving space for receiving the back plate, the radially outer end of the body has an axial end remote from the cover and located farther from the cover than the second axial end surface of the back plate.

12. The centrifugal impeller of claim 11, wherein the body is made of a homogenous plastic material.

13. The centrifugal impeller of claim 11, wherein the back plate defines a plurality of through holes and the body forms a plurality of protrusions, each of the protrusions is formed on a respective vane, and each of the protrusions extends through a respectively through hole and is fixedly connected to the back plate.

14. The centrifugal impeller of claim 13, wherein each of the protrusions has a free end remote from the corresponding vane and extending beyond the back plate.

15. The centrifugal impeller of claim 14, wherein the protrusions of the body are hot staked onto the back plate.

16. The centrifugal impeller of claim 11, wherein the body further comprises an outer ring which is connected to radially outer ends of the plurality of vanes, and the receiving space is defined by the outer ring.

17. The centrifugal impeller of claim 13, wherein the number of the plurality of protrusions is less than the number of the plurality of vanes, and the protrusions are evenly spaced along a circumferential direction of the body.

18. The centrifugal impeller of claim 17, wherein the plurality of vanes comprise a plurality of first vanes and a plurality of second vanes, each second vane has a radial length less than a radial length of each first vane, and each protrusion of the body is formed on a respective second vane.

* * * * *